US009561903B2

(12) United States Patent
Wall

(10) Patent No.: US 9,561,903 B2
(45) Date of Patent: Feb. 7, 2017

(54) RECEPTACLE HAVING A HOUSING AND INNER VESSEL ASSEMBLY FOR LINER ENGAGEMENT

(71) Applicant: Test Rite Products Corp., Ontario, CA (US)

(72) Inventor: Joseph Wall, Thatcher, AZ (US)

(73) Assignee: Test Rite Products Corp., Ontario, CA (US)

( * ) Notice: Subject to any disclaimer, the term of this patent is extended or adjusted under 35 U.S.C. 154(b) by 0 days.

(21) Appl. No.: 14/621,516

(22) Filed: Feb. 13, 2015

(65) Prior Publication Data

US 2016/0236863 A1 Aug. 18, 2016

(51) Int. Cl.

| | |
|---|---|
| ***B65F 1/08*** | (2006.01) |
| ***B65F 1/06*** | (2006.01) |
| *B65F 1/14* | (2006.01) |
| *B65D 88/16* | (2006.01) |
| *B65D 25/14* | (2006.01) |
| *B65D 90/04* | (2006.01) |
| *B65D 25/16* | (2006.01) |
| *B65D 25/18* | (2006.01) |

(52) U.S. Cl.

CPC . *B65F 1/08* (2013.01); *B65F 1/06* (2013.01); *B65D 25/14* (2013.01); *B65D 25/16* (2013.01); *B65D 25/18* (2013.01); *B65D 88/1606* (2013.01); *B65D 88/1618* (2013.01); *B65D 90/046* (2013.01); *B65F 1/163* (2013.01); *B65F 1/1646* (2013.01); *Y10S 220/908* (2013.01); *Y10S 220/9081* (2013.01)

(58) Field of Classification Search

CPC ..... B65F 1/06; B65F 1/08; B65F 1/163; B65F 1/1646; B65D 25/14; B65D 25/16; B65D 25/18; B65D 88/1618; B65D 88/1606; B65D 90/046; Y10S 220/908; Y10S 220/9081

USPC ..... 220/495.11, 908, 908.1, 23.87, 604,220/495.01, 495.06, 495.08

See application file for complete search history.

(56) References Cited

U.S. PATENT DOCUMENTS

| | | | | |
|---|---|---|---|---|
| 4,555,339 | A * | 11/1985 | Graves | A47J 43/28 210/244 |
| 6,590,146 | B1 | 9/1986 | Isaacs | |
| 5,411,161 | A | 5/1995 | Fish, Jr. | |
| 8,033,414 | B2 | 10/2011 | Conforti | |
| 8,061,554 | B2 * | 11/2011 | Shikano | B65F 1/06 220/263 |
| 8,297,644 | B2 | 10/2012 | Sheehan | |
| 8,720,728 | B2 | 5/2014 | Yang | |
| 2006/0191938 | A1 | 8/2006 | Zephir | |
| 2009/0039081 | A1 * | 2/2009 | Fort | B65F 1/06 220/23.87 |
| 2013/0048641 | A1 | 2/2013 | Romano | |

* cited by examiner

*Primary Examiner* — J. Gregory Pickett
*Assistant Examiner* — Elizabeth Volz
(74) *Attorney, Agent, or Firm* — Treasure IP Group, LLC

(57) ABSTRACT

A receptacle assembly disclosed herein includes a receptacle housing, a liner assembly having a base member and an insertion member, wherein the insertion member is situated above the base member in either a rejection position or an acceptance position. When the insertion member is placed in its acceptance position with respect to the base member, the receptacle assembly can hold a drape over portion of another liner between the insertion member and the receptacle housing.

13 Claims, 11 Drawing Sheets

RECEPTACLE HAVING A HOUSING AND INNER VESSEL ASSEMBLY FOR LINER ENGAGEMENT

FIELD OF THE INVENTION

The present invention relates to a receptacle having an inner vessel assembly, specifically it is related to a receptacle having an inner vessel assembly to engage a liner.

DESCRIPTION OF THE RELATED ART

Receptacles, in general, mostly are used with disposable flexible liners such as a paper, cloth, or plastic bag, for easy and sanitary disposal of trash, which is thrown therein. Often times, the liner used for a receptacle interior is provided with extra length to enable an upper portion of the liner to be draped over the top rim of the trashcan and to extend downwardly along a portion of an exterior surface of the trash can. However, if such a liner is left loosely draped over the top rim of the receptacle, the liner can easily slip into the interior of the receptacle when trash is placed in the receptacle.

One way to solve this problem is to have a tightening mechanism attached to the receptacle liner, but it is not practical to design said liner for every size and type of receptacle. Therefore a securing mechanism is needed so as to have the flexible receptacle liner remain conformed to the side and top rim of the receptacle so that the receptacle liner will not slip into the bottom of the receptacle when trash is placed in it.

SUMMARY OF THE INVENTION

Many liner engagement means have been disclosed in the art. However, most of them allow the drape over portion of the flexible liner to be dangling on the outside of the receptacle. It is one object of the present invention to provide a liner engagement means that the drape over portion of the flexible liner is tightly disposed on the interior of a receptacle and is not visible from the outside of the receptacle. The present invention provides a receptacle wherein the hang over portion of the flexible liner is hidden in an aesthetically pleasing housing.

The present invention discloses a receptacle comprising a receptacle housing and an inner vessel assembly. The receptacle housing comprises a bottom, a peripheral wall extending upwardly from said bottom, and a top rim of said peripheral wall defining an opening of the receptacle housing. The inner vessel assembly, configured to be placed inside the receptacle housing, can be set up into either a rejection position or an acceptance position. In the rejection position, a flexible liner is placed in the inner vessel assembly allowing a top portion of the flexible liner to fold over a top rim of the inner vessel assembly. In the acceptance state, the hang over portion of the flexible liner is secured in place between the top portion of the inner vessel assembly and the top portion of the receptacle. The acceptance position and rejection position are interchanged by turning an insertion member 90 degrees or less with respect to a base member of the inner vessel assembly.

The inner vessel assembly, configured to be placed inside the receptacle housing, comprises a base member and an insertion member. The base member is situated directly on top of the bottom of the receptacle housing, bearing a first feature. The insertion member, which is an enclosure having a body including a bottom and a peripheral wall extending upwardly from said the bottom of the insertion member, and a top rim of said peripheral wall of the insertion member defining an opening of the insertion member. And the insertion member is moveable inside the receptacle housing and bears a second feature. The second feature of the insertion member is complementary to the first feature of the base member. The second feature is configured to allow the insertion member be placed on top of the base member and supported by the base member either in a rejection position, having the first and second features not aligned or an acceptance position, having the first and second features aligned; and when the insertion member is assembled in the acceptance position with regard to the base member, the receptacle assembly is configured to engage a second liner by sandwiching the flexible liner between the insertion member and the receptacle housing.

In one embodiment of the present invention, the first feature of the base member has a plurality of protrusions.

In another embodiment of the present invention, the second feature of the insertion member is on the exterior surface of the peripheral walls of the body of the insertion member, near the bottom of the insertion member. In one example, the second feature of the insertion member has a plurality of grooves.

Optionally, the receptacle housing further comprises a lid.

Optionally, the receptacle housing further comprises a foot-operated pedal to open and dose the lid.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
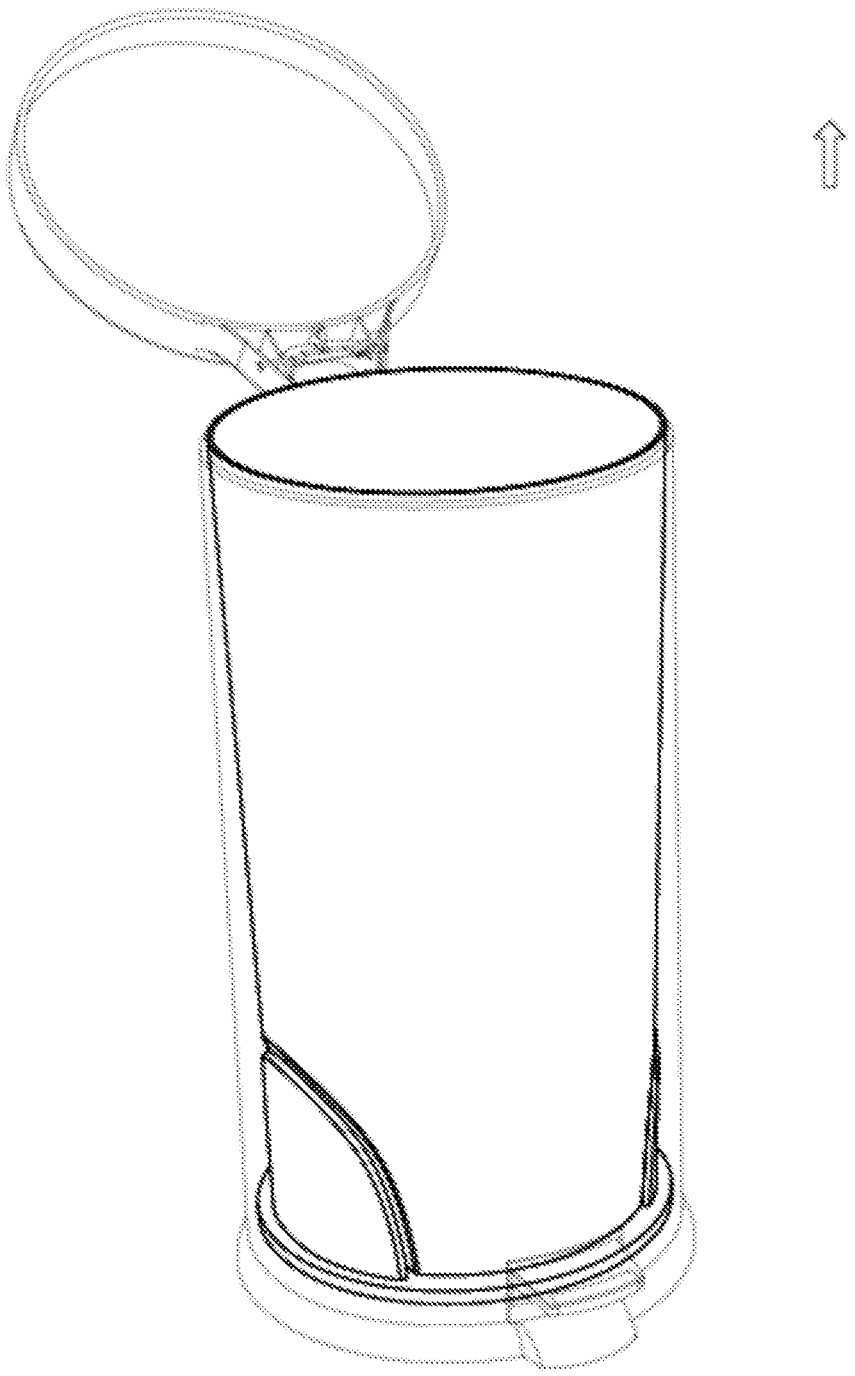
FIG. 1 is a perspective view of the inner vessel assembly in accordance with the present invention, wherein the insertion member is accepted by the base member.

For purposes of summarizing the invention and the advantages achieved over the prior art, certain advantages of the invention have been described herein. It is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

In the scope of the present invention, a receptacle is referred in general to a container. In one example, it is a trashcan for residential use. In another example, it is a diaper pale. In the scope of the present invention, when the receptacle is a trashcan, the inner vessel assembly can also be referred to as an inner trashcan.

In the scope of the present invention, the inner vessel assembly can adopt any of the following positions, including an acceptance position, a rejection position, a projected acceptance position and a projected rejection position. Acceptance position means the insertion member is accepted by the base member, wherein a top rim of the insertion member is substantially at the same height of a top rim of the receptacle housing, a lid for the receptacle can be reasonably comfortably closed, and the inner vessel assembly is placed inside the receptacle. Rejection position means the insertion member is supported by the base member in a rejection position, wherein the top rim of the insertion member is positioned higher than the top rim of the receptacle housing, and the lid for the receptacle can not be reasonably comfortably closed. Projected acceptance position is that the insertion member is placed above the base member separated by a space, in a configuration that the insertion member would have been accepted by the base member if the space between the two is eliminated and the insertion member and the base member is in direct contact. Projected rejection position is that the insertion member is placed above the base member separated by a space, in a configuration that the insertion member would have been rejected by the base member if the space between the two is eliminated and the insertion member and the base member is in direct contact. In both the projected acceptance position and projected rejection position, the insertion member of the inner vessel assembly has a first half outside of the receptacle housing and a second half inside of the receptacle housing.

In the scope of the present invention, the receptacle disclosed herein includes a receptacle housing and an inner vessel assembly. The receptacle housing, which comprises a base member and a peripheral wall extending upwardly from said base member, a top rim of said peripheral wall defining an opening of the receptacle body, wherein the top rim of peripheral wall is opposite to the base member of the receptacle body. The receptacle housing may further comprise a lid, which covers the top of the outer receptacle housing.

Optionally, the receptacle housing may further comprise a mechanism to open and close the lid for the receptacle. In one example, the receptacle housing comprises a foot-operated pedal to open and close the receptacle lid. In another example, the receptacle comprises an automatic mechanism to open and close the receptacle lid. Further, the lid open and close mechanism comprises a damping motion.

The receptacle housing in accordance with the aspects of the present invention can be of any shape, including but not limited to cylinder and cubic shaped, or variations thereof. Referring to FIGS. 1-12, in one example, the receptacle is cylinder shaped having a bottom, which is round or oval shaped. The peripheral wall is one integral side. In another example the receptacle is rectangular or cubic shaped, and the peripheral walls consists of four sides, one connected to two neighboring sides. The peripheral wall of the receptacle in accordance with the aspects of the present invention can include additional surface features for both aesthetic and functional purposes. For example, the peripheral wall of the receptacle can be tapered or having rings or grooves like exterior surface features.

The inner vessel assembly, referring to FIGS. 1-12, in accordance with the aspects of the present invention, comprises a base member 102 and an insertion member 103. The base member 102 and insertion member 103 form one assembly to be placed inside the receptacle housing.

Figure 2:
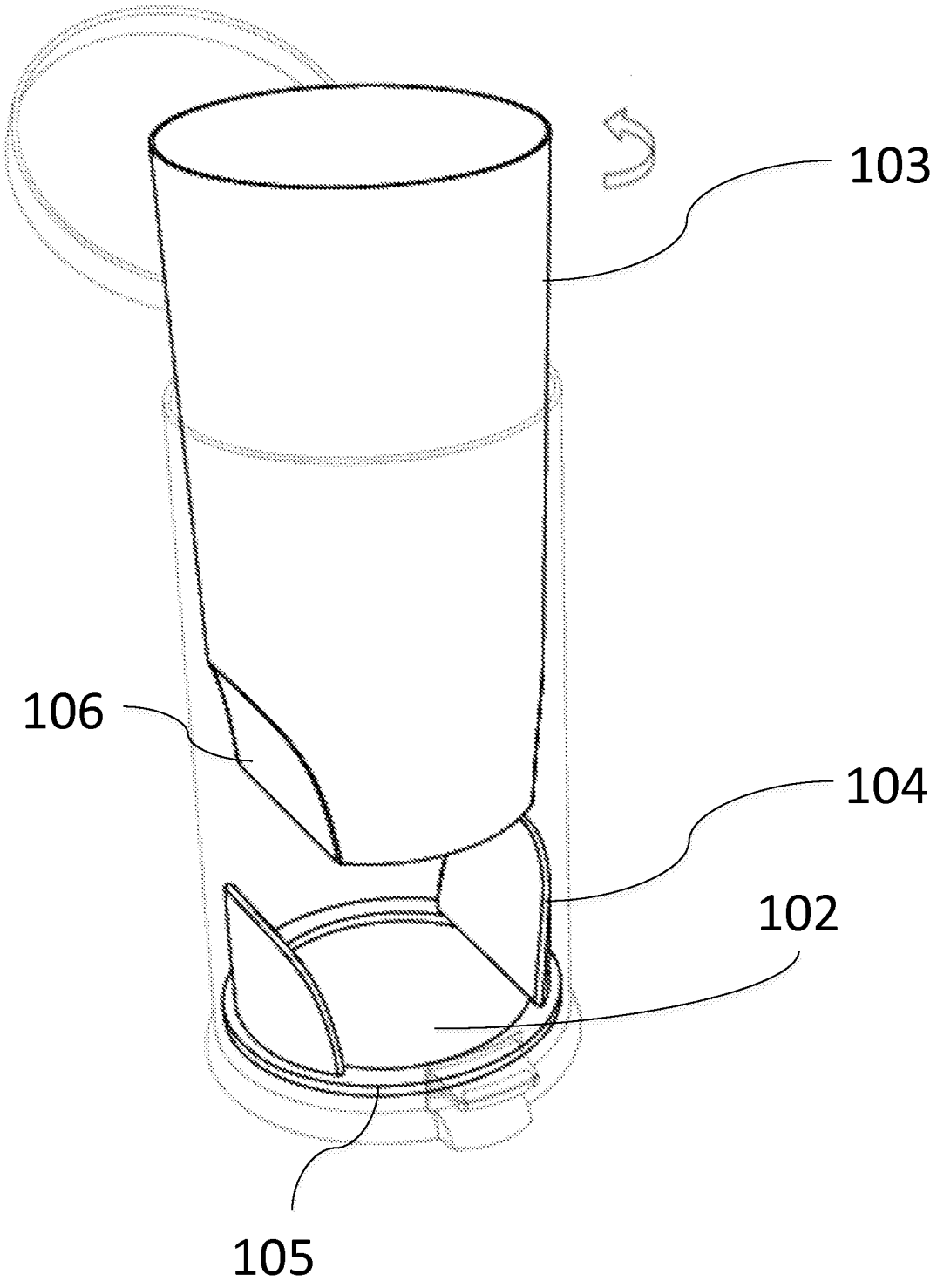
FIG. 2 is another perspective view of the receptacle assembly in FIG. 1, wherein the insertion member is removed from the base member to an intermediate projected acceptance position.
Figure 10:
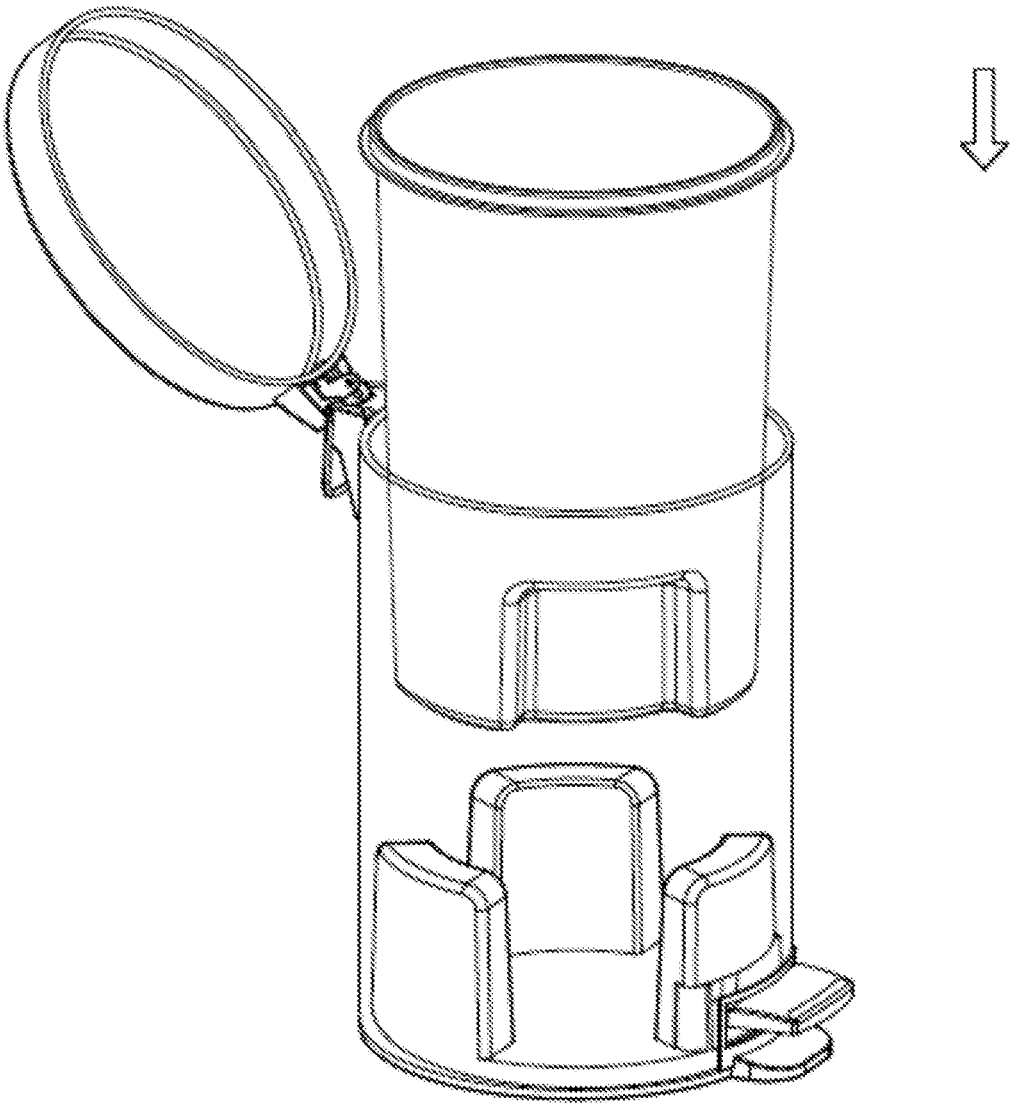
FIG. 10 is an alternative embodiment of the present invention, wherein the insertion member is detached from the base member to an intermediate projected acceptance position.
Figure 11:
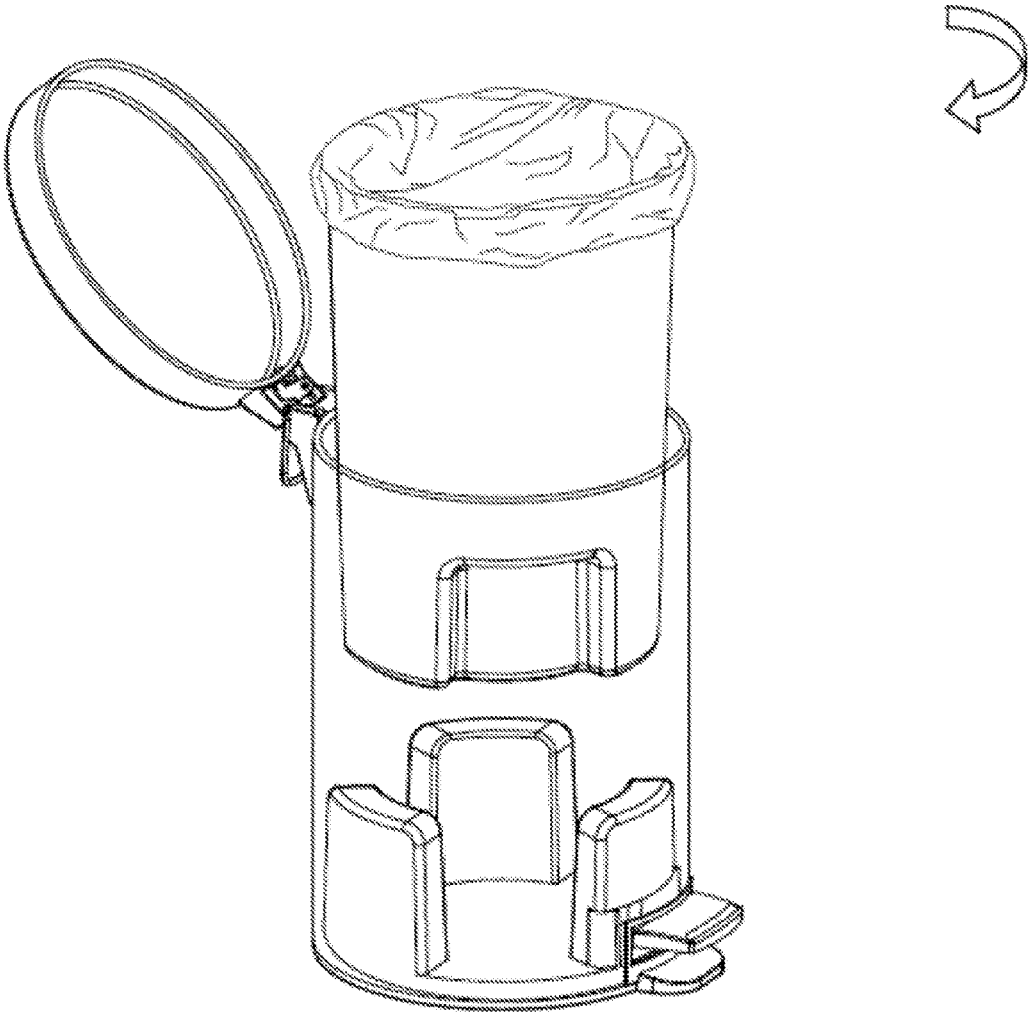
FIG. 11 is an alternative embodiment of the present invention, wherein the insertion member is detached from the base member to an intermediate projected rejection position and a flexible liner is placed on the inner vessel assembly.
Figure 12:
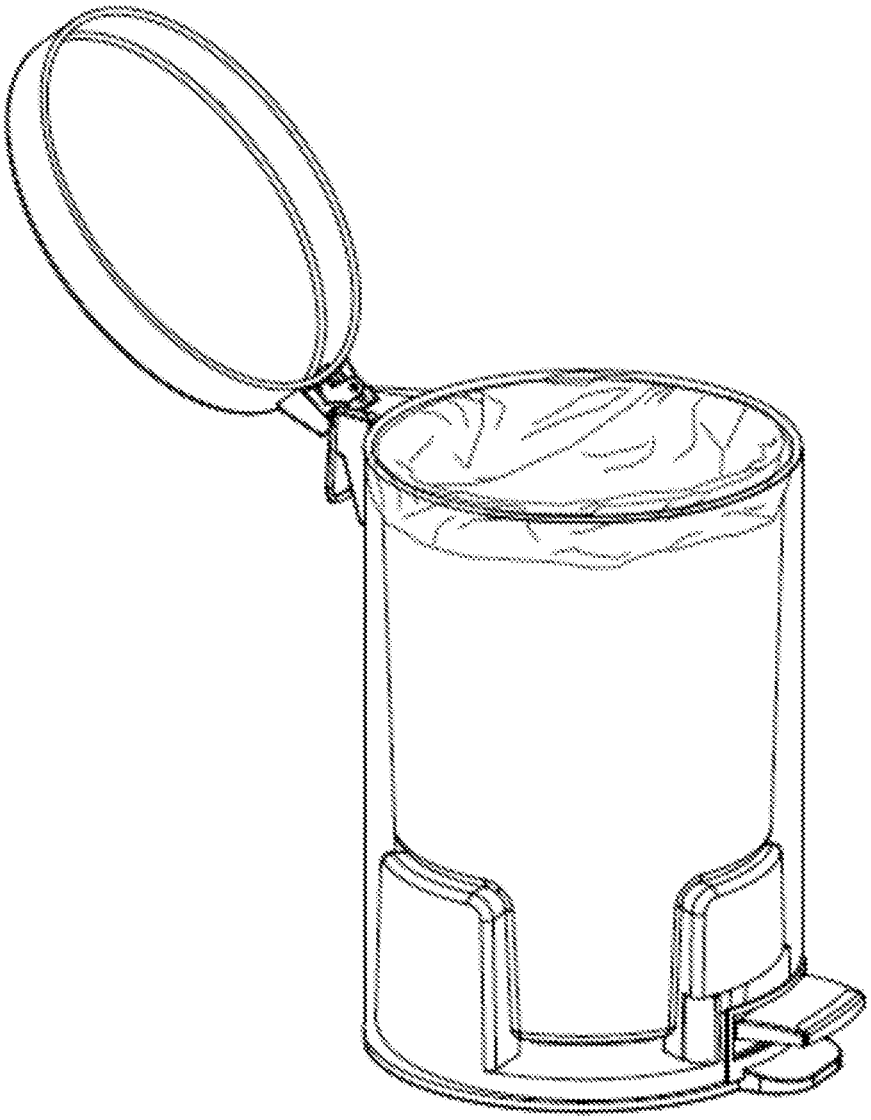
FIG. 12 is an alternative embodiment of the present invention, wherein the insertion member is in its acceptance position with regard to the base member and the flexible liner is secured between the top of the first liner assembly and the top of the receptacle housing.

The base member 102 can either be permanently fixed onto the interior surface of the bottom of the receptacle housing or detachable from the inner surface of the bottom of the receptacle housing. The base member 102 comprises a first feature 104 and a holding member 105, wherein the holding member 105 holds the first feature 104 in desired location. In one embodiment the first feature 104 is a plurality of protrusions. In one example, the protrusions are leaf or pedal shaped as shown in FIG. 2. In another example, the protrusions are mountain or peak shaped as illustrated in FIG. 10. In another embodiment, the holding member 105 resembles the geometry of the bottom of the receptacle housing. In one example, the bottom of the receptacle is round and the holding member is also round. In another example the bottom of the receptacle is oval and the holding member is also oval. In one instance, the holder member 105 is a ring like-hollow structure, wherein the first feature anchored on the ring but extends vertically from the ring 105, as depicted in FIG. 2. In another instance, the holder member 105 is a round disk, wherein the first feature is formed on top of the disk along its circumference and extends vertically from the disk as shown in FIG. 11.

In accordance with the aspects of the present invention, the insertion member 103 is a container or an enclosure, having a body including a bottom and a peripheral wall extending upwardly from said bottom of the insertion member, and a top rim of said peripheral wall of the insertion member defining an opening of the insertion member. Further, the insertion member 103 bears a second feature 106. The second feature is configured to allow the insertion member 103 to be placed on top of the base member 102 and supported by the base member either in a rejection position or acceptance position. In the rejection position, the top rim of the insertion member is positioned higher than the top rim of the receptacle housing, whereas in the acceptance position, the top rim of the insertion member is substantially level with the top rim of the receptacle housing.

In one aspect of the present invention, in one embodiment, the second feature is complementary to the first feature of the base member. In one example, when the first feature is a plurality of protrusions, the second feature is a plurality of grooves. In another example, when the first feature is a plurality of female joints, then the second feature is a plurality of male joints, or vice versa.

In another aspect of the present invention, in one embodiment, when the insertion member and the base member are in the rejection position, the second feature of the insertion member and first feature of the base member are not aligned, and when the insertion member and the base member take an acceptance position, the second feature of the insertion member and first feature of the base member are aligned. In another embodiment, when the insertion member bears female joint and the base member bears a male joint, insertion member and the base member take a rejection position, the second feature of the insertion member and the first feature of the base member are not properly connected to allow the male joint to be placed inside the female joint, and when the insertion member and the base member take an acceptance position, the second feature of the insertion member and the first feature of the base member are properly connected to allow the male joint to be placed inside the female joint.

In a third aspect of the present invention, in one embodiment, the second feature of the insertion member is disposed on the peripheral wall of the insertion member and the first feature of the base member is disposed along the circumference of the ring-like holding member. In an alternative embodiment, the second feature of the insertion member is disposed on the bottom of the insertion member and the first feature of the base member is disposed between the circumference and the center of the ring-like holding member.

In a fourth aspect of the present invention, in one embodiment, when the insertion member is supported by the base member and the injection member and the base member take a rejection position, the insertion member is raised up so that the top rim of the insertion member is above the top rim of the exterior receptacle housing. When a flexible liner is placed inside the insertion member, a top portion of the flexible liner can freely hang over the top rim of the insertion member. When the insertion member is acceptably supported by the base member (injection member and the base member take a rejection position), the insertion member is comfortably fitted so that the top rim of the insertion member is level with the top rim of the exterior receptacle housing, that is the top rim of the insertion member and the top rim of the exterior receptacle housing are substantially at the same height. The hang over portion of the flexible liner can be sandwiched or squeezed in between the exterior surface of the top portion of the insertion member and interior surface of the top portion of the receptacle housing.

The present invention also discloses a method of using a receptacle having an inner vessel assembly. The method comprises the steps as illustrated in FIGS. 1-9. First, a receptacle having a housing and an inner vessel assembly for liner engagement is provided. The inner vessel assembly comprises a base member and an insertion member. Referring to FIG. 1, the inner vessel assembly is placed inside of the receptacle housing, the base member and the insertion member adopt an acceptance position wherein the top rim of the insertion member and the top rim of the receptacle housing are substantially at the same height.

Then, the insertion member inside the receptacle housing is lifted up to adopt a projected acceptance position (FIGS. 1-2). In the projected acceptance position, the insertion member has an upper portion above the top rim of the receptacle housing and outside of the receptacle housing, and a lower portion below the top rim of the receptacle housing and kept inside of the receptacle housing.

Figure 3:
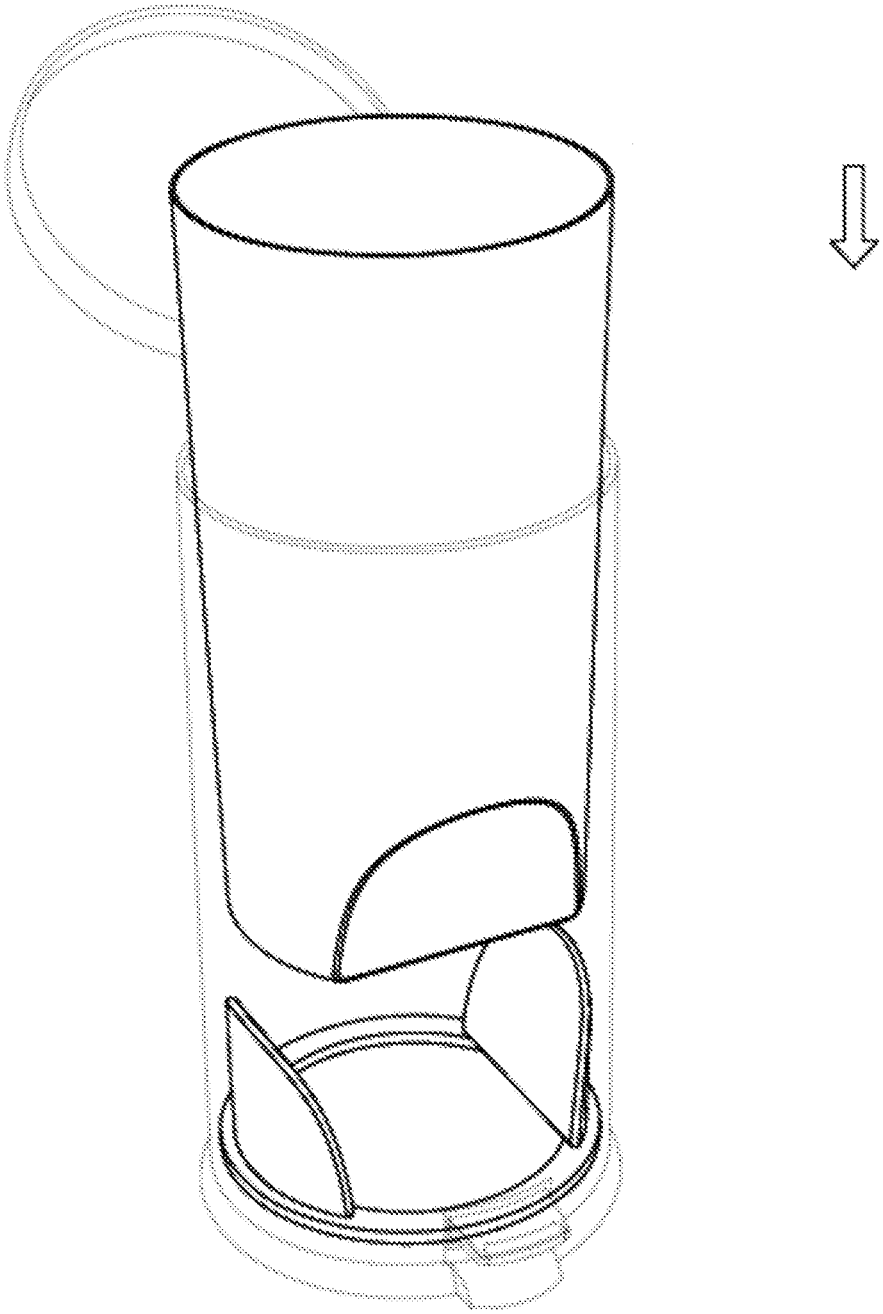
FIG. 3 is another perspective view of the receptacle assembly in FIG. 1, wherein the insertion member is turned from its position in FIG. 2 to an intermediate projected rejection position.

Subsequently, the insertion member is turned either clockwise or counter-clock wise between 0-180 degrees to adopt a projected rejection position (FIGS. 2-3). As shown in FIGS. 2-3, the insertion member is turned 90 degrees. As shown in FIG. 11, the insertion member is turned 60 degrees.

Figure 4:
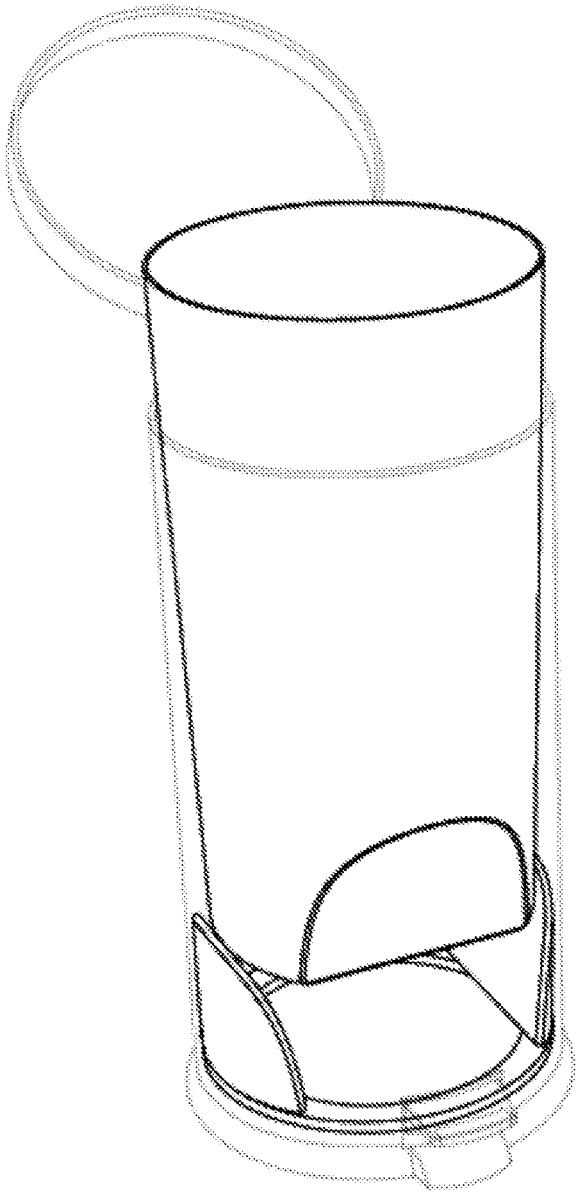
FIG. 4 is another perspective view of the receptacle assembly in FIG. 1, wherein the insertion member is moved downward from its position in FIG. 3 and rejected by the base member.
Figure 5:
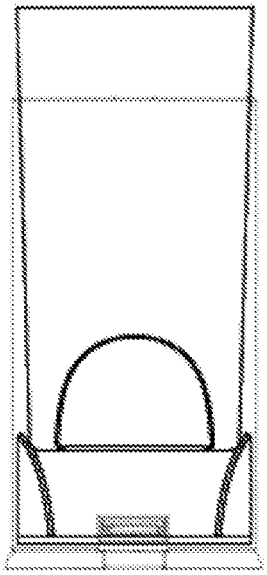
FIG. 5 is a front view of the liner assembly of FIG. 4.

Further the insertion member is moved downwardly so that the insertion member is rested and supported by the base member in a rejection position. FIG. 4 is a perspective view of the vessel assembly in the rejection position and FIG. 5 is a front view of vessel assembly in the rejection position.

As desired, a flexible liner of choice is placed inside of the insertion member, having an extra portion folded over the top rim of the insertion member. Further, as illustrated in FIG. 6, the length of the hang over portion of the flexible member is less than the distance between the top rim of the insertion member and the top rim of the receptacle housing.

Figure 6:
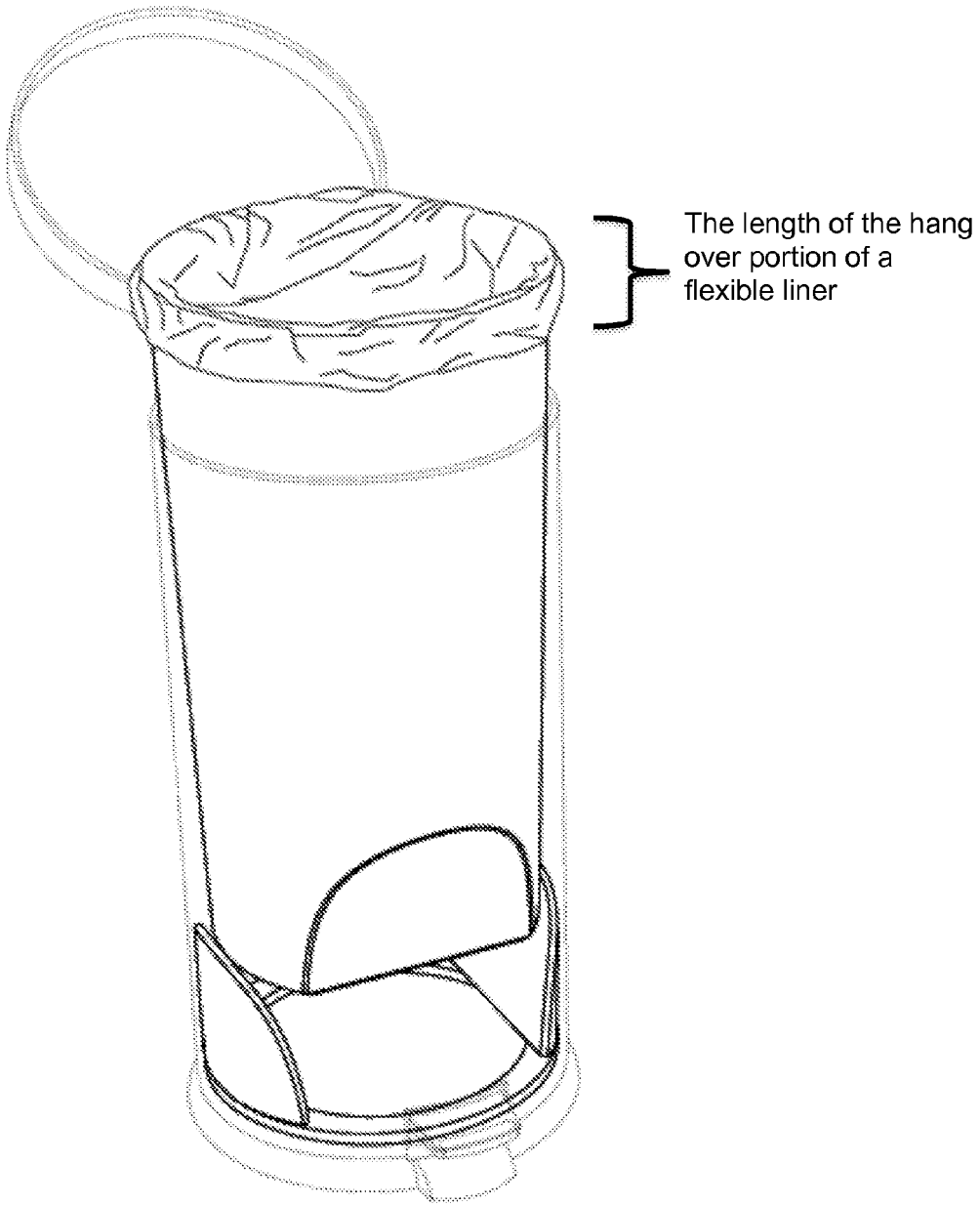
FIG. 6 is another perspective view of the liner assembly in FIG. 4, when a trash bag is fixed.
Figure 7:
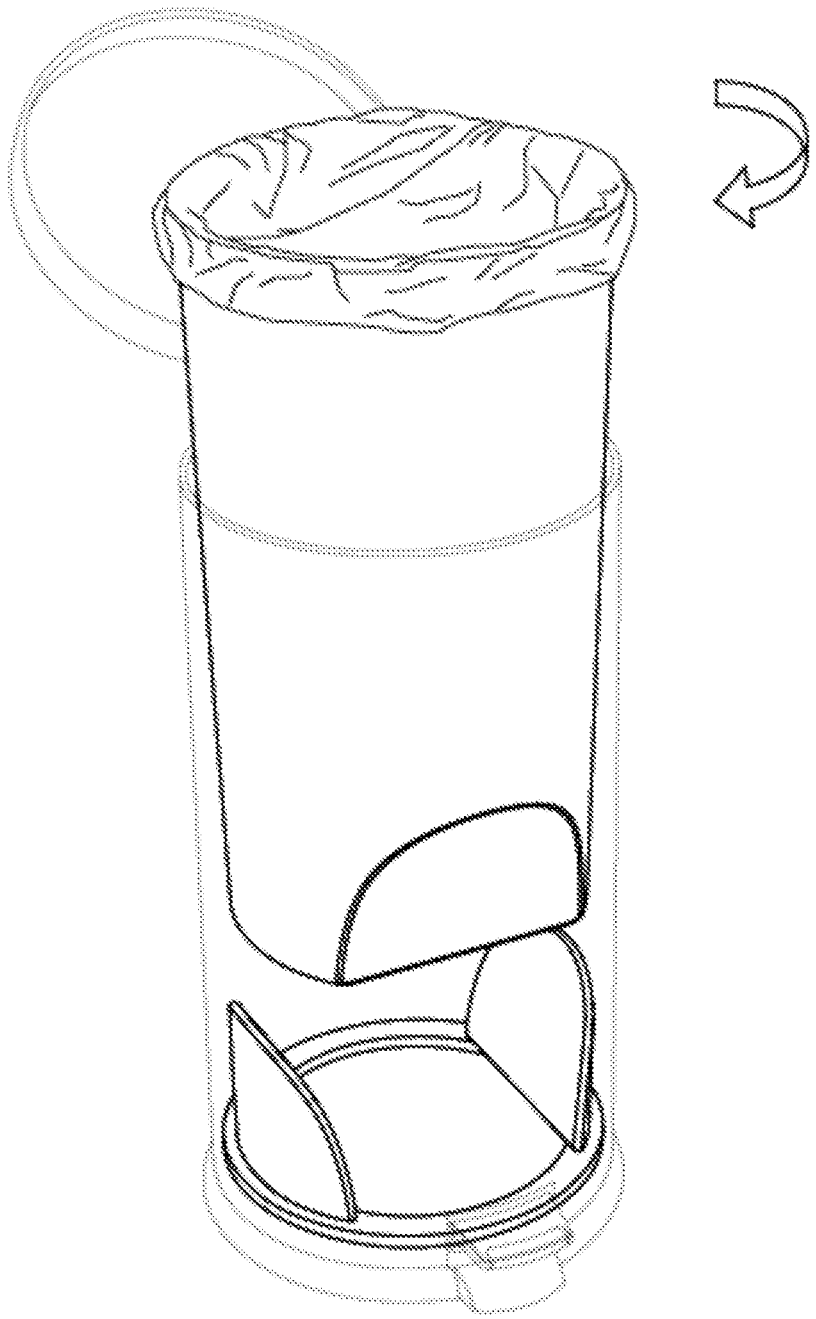
FIG. 7 is another perspective view of the liner assembly in FIG. 6, when the insertion member is moved upward to another intermediate rejection position.
Figure 8:
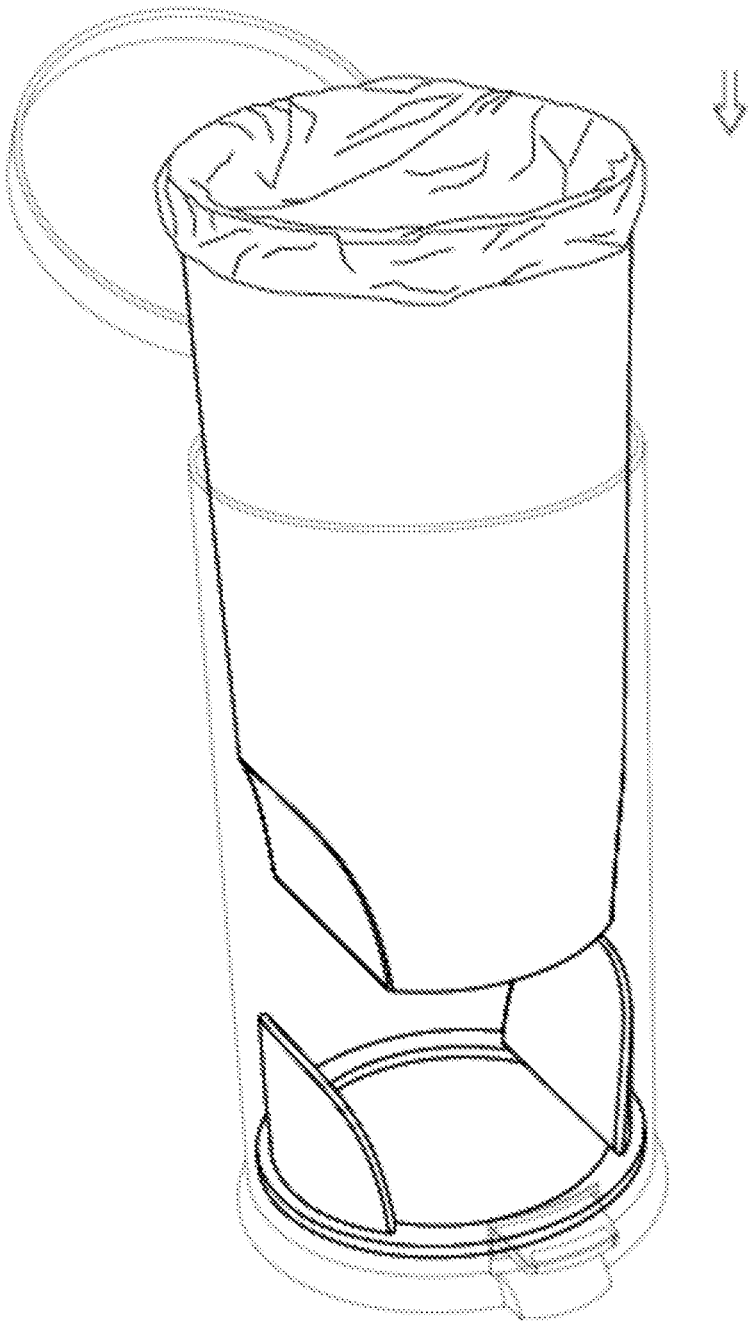
FIG. 8 is another perspective view of the receptacle assembly in FIG. 6, when the insertion member is turned from its position in FIG. 7 to another intermediate acceptance position.
Figure 9:
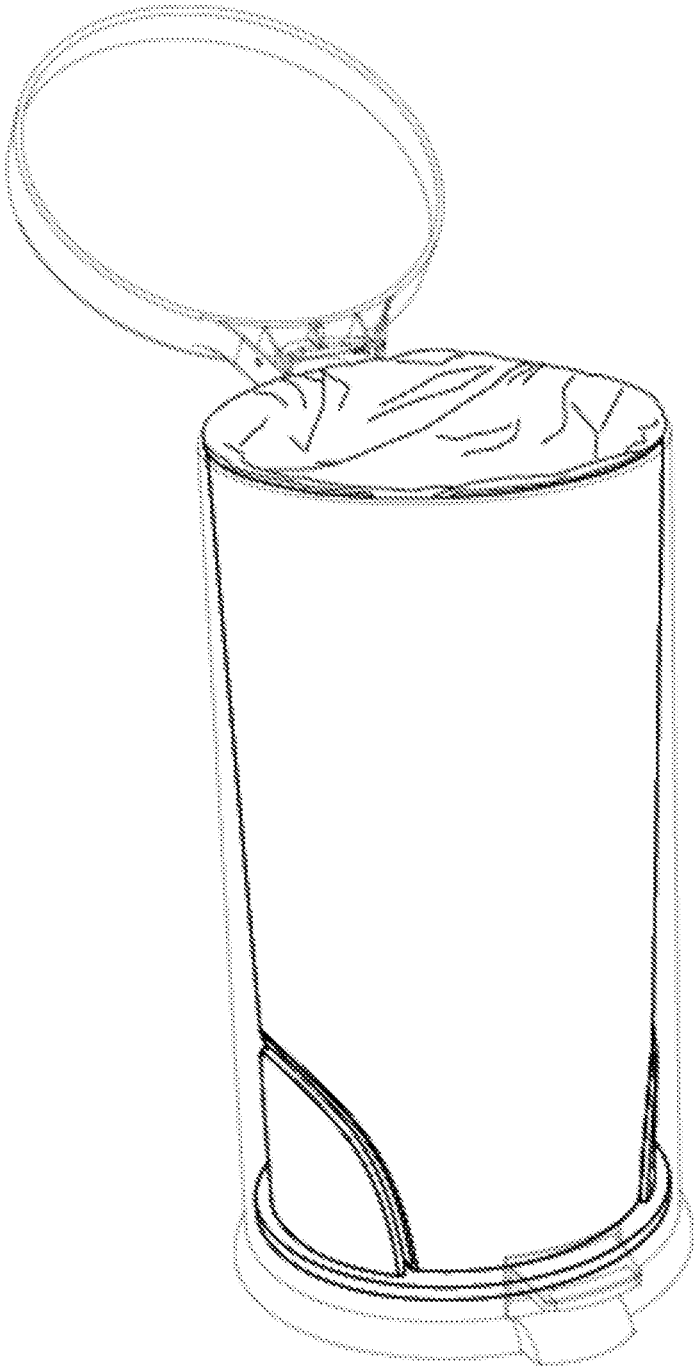
FIG. 9 is another perspective view of the receptacle assembly in FIG. 6, when the insertion member is moved downward to its acceptance position.

After the liner is fixed as shown in FIG. 6, the insertion member is once again lifted up to adopt a projected rejection position as shown in FIG. 7. Then the insertion member together with the flexible liner adhered thereon, is turned either clockwise or counter clockwise to a projected acceptance position. As shown in FIG. 8, in the projected acceptance position, the grooves (the second feature) of the insertion member and the protrusions (the first feature) of the base member are vertically aligned to prepare the insertion member to comfortably fit on the base member in a complementary configuration.

Lastly, the insertion member is moved downward to the inside of the receptacle housing. The flexible liner moves along with insertion member and the hang over portion of the flexible liner is secured in place between the exterior surface of the top of the insertion member and the interior surface of the top of the receptacle housing, and not movable when trash is receive in the receptacle.

It will be appreciated by those of skilled in the art that a new and useful receptacle having a inner vessel assembly for liner engagement has been described herein. In view of the many possible embodiments, however, it should be recognized that the embodiments described herein with respect to the drawing figures are meant to be illustrative only and should not be taken as limiting the scope of what is claimed. Those of skill in the art will recognize that the illustrated embodiments can be modified in arrangement and detail. Therefore, the systems and methods as described herein contemplate all such embodiments as may come within the scope of the following claims and equivalents thereof. In the claims, only elements denoted by the words "means for" are intended to be interpreted as means plus function claims under 35 U.S.C. §112, the sixth paragraph.

The invention claimed is:

1. A receptacle, comprising a receptacle housing, comprising a bottom, a peripheral wall extending upwardly from said bottom, and a top rim of said peripheral wall defining an opening of the receptacle housing;

an inner vessel assembly, configured to be placed inside the receptacle housing, comprising a base member, situated directly on top of the bottom of the receptacle housing, and bearing a first feature;

an insertion member, which is an enclosure having a body including a bottom and a peripheral wall extending upwardly from said bottom of the insertion member, and a top rim of said peripheral wall of the insertion member defining an opening of the insertion member; and a second feature, complementary to the first feature, situated on a lower portion of the exterior wall of the insertion member, allowing the insertion member and base member to be assembled in either a rejection position or an acceptance position;

wherein the receptacle is configured to engage a liner by sandwiching the liner between the inner vessel assembly and the outer receptacle housing when the insertion member and base member take the acceptance position; in the rejection position, the body of the insertion member is supported by the second feature of the base member of the inner vessel assembly so that a top portion of the liner to hang over a top rim of the first inner vessel assembly;

and the rejection state can be turned into acceptance by turning clockwise or counter clockwise without taking the insertion member out of the receptacle housing.

2. The receptacle assembly of claim 1, wherein the first feature of the base has a plurality of protrusions.

3. The receptacle assembly of claim 1, wherein the second feature of insertion member has a plurality of grooves.

4. The receptacle assembly of claim 1, wherein when the insertion member is in the rejection position with regard to the base member, the top rim of the body of the insertion member is higher than the top rim of the receptacle housing.

5. The receptacle assembly of claim 1, wherein when the insertion member is in the acceptance position with regard to the base member, the top rim of the body of the insertion member is substantially on same level with the top rim of the receptacle housing.

6. The receptacle assembly of claim 1, wherein the receptacle housing further comprises a lid.

7. The receptacle assembly of claim 1, wherein the receptacle housing further comprises a pedal.

8. A receptacle assembly, comprising a receptacle housing comprising a bottom, and a peripheral wall extending upwardly from said bottom;

a first inner vessel assembly, comprising a base member and an insertion member, wherein the insertion member and base member are configured to be placed inside the receptacle housing, such that the insertion member and base member can be aligned in a rejection state or an acceptance state;

in the rejection state, a liner can be placed in the first inner vessel assembly allowing a top portion of the second liner to hang over a top rim of the first inner vessel assembly, and in the acceptance state, the hang over portion of the liner is secured in place between the top portion of the first inner vessel assembly and a top portion of the receptacle, and wherein the acceptance state and rejection state are interchangeable by turning the insertion member 90 degrees or less with respect to the base member of the first inner vessel assembly.

9. A method to use a receptacle, comprising providing a receptacle having a receptacle housing having a base and a peripheral wall extending upwardly from said base; and an inner vessel assembly for liner engagement, wherein the inner vessel assembly comprises an insertion member and a base member, and wherein the insertion member having a first feature on its body and the base member having a second feature, and the first feature and the second feature complementary to each other;

placing the base member inside the receptacle housing;

lifting the insertion member to a projected acceptance position, having a first half of the insertion member exposed outside of the receptacle housing and a second half of the insertion member hidden inside of the receptacle housing;

turning in a first angle to a projected rejection position without taking the insertion member outside the receptacle housing, having the first half of the insertion member exposed outside of the receptacle housing and the second half of the insertion member hidden inside of the receptacle housing;

moving the insertion member down into a rejected position so that the body of the insertion member is supported by the second feature of the base member in a rejection position;

placing a flexible liner in the insertion member having an extra length of the flexible liner fold and hang over a top rim of the insertion member when the insertion member is in the rejected position;

lifting the insertion member up to the projected rejection position and turning the insertion member at a second angle to a projected acceptance position; and moving the insertion member downwardly and placing the insertion member back into the receptacle housing in an acceptance position, having the hang over portion of the flexible liner secured between the inner vessel and the receptacle housing without a latch.

10. The method of claim 9, wherein when the insertion member is supported by the base member in a rejection position, the top rim of the insertion member is positioned higher than the top rim of the receptacle housing.

11. The method of claim 9, wherein the first angle and second angle are less than 90 degrees.

12. The method of claim 9, wherein the first angle is 60 degrees.

13. The method of claim 9, wherein the second angle is 60 degrees.

* * * * *